US005407330A

United States Patent [19]

Rimington et al.

[11] Patent Number: 5,407,330

[45] Date of Patent: Apr. 18, 1995

[54] AIR PUMP APPARATUS WITH VIBRATION AND SOUND REDUCING HOUSING MEANS

[75] Inventors: Richard M. Rimington, Presteigne; Richard E. Fletcher, Leominster, both of United Kingdom

[73] Assignee: Mangar International Limited, Powys, Wales

[21] Appl. No.: 121,125

[22] Filed: Sep. 14, 1993

[30] Foreign Application Priority Data

Oct. 24, 1992 [GB] United Kingdom ..... 9222475

[51] Int. Cl.[6] ..... F04B 19/04; H02K 5/24

[52] U.S. Cl. ..... 417/312; 417/313; 417/363; 181/202

[58] Field of Search ..... 417/234, 312, 313, 363, 417/44 R, 411; 415/119; 181/189, 200, 202

[56] References Cited

U.S. PATENT DOCUMENTS

| | | | |
|---|---|---|---|
| 4,201,523 | 5/1980 | Olofsson | 417/312 |
| 4,715,787 | 12/1987 | Hung | 417/234 |
| 4,733,750 | 3/1988 | Poirier et al. | 181/202 |
| 5,052,894 | 10/1991 | Remington | 417/234 |
| 5,151,018 | 9/1992 | Clendenin et al. | 417/313 |

FOREIGN PATENT DOCUMENTS

| | | | |
|---|---|---|---|
| 521571 | 8/1953 | Italy | 417/363 |
| 27112 | 3/1978 | Japan | 417/313 |
| 3253800 | 11/1991 | Japan | 417/312 |
| 5-010268 | 1/1993 | Japan | 417/312 |

*Primary Examiner*—Richard A. Bertsch
*Assistant Examiner*—Roland G. McAndrews, Jr.
*Attorney, Agent, or Firm*—Neil F. Markva

[57] ABSTRACT

Portable, low noise air pump apparatus employing an inexpensive lightweight pump and motor unit, which pumps a pulsed noisy output into a plenum chamber inside a rubber impervious sub-housing which absorbs noise and vibration; and a sound deadening plastics tube which carries the compressed air from the plenum, via a sound absorbing chamber (surrounded by lightweight sound absorbing material which supports the sub-housing) and across an accommodation space to an outlet fitting from which a smooth low-noise compressed air output can be supplied.

24 Claims, 8 Drawing Sheets

AIR PUMP APPARATUS WITH VIBRATION AND SOUND REDUCING HOUSING MEANS

This invention concerns air pump apparatus.

FIELD OF THE INVENTION

BACKGROUND OF THE INVENTION

There are kinds of goods comprising pumps (e.g. motor tire inflators and air compressors for vehicle horns) which are noisy but for which the sales market for such goods is so large and the operational requirements so simple that the cost thereof can be minimized by volume mass production. However, such pumps are inherently noisy and are not suitable for other purposes where noise is detrimental. Additionally, there are requirements for relatively small quantities of pump units for special applications requiring complex control systems, such as pump units for air pump apparatus for powering and controlling pneumatically operated equipment, e.g. lifting seats for disabled persons or dentists drills, but such specialized pump units are invariably relatively expensive, complex and massive.

SUMMARY OF THE INVENTION

The problems of noise, expense, complexity and bulk are faced by the invention, and to reduce these problems the present invention generally provides air pump apparatus comprising:

(a) a rigid housing (b) a sound absorption chamber in said housing (c) pump means in said sound absorption chamber (d) duct means within said housing for conveying air from said pump means wherein (e) said apparatus further comprises a sub-housing which is disposed in the sound absorption chamber and defines a plenum chamber to which said duct means connects; and (f) said pump means comprises a pump and motor unit mounted in said plenum chamber to discharge air under pressure into said plenum chamber.

More particularly, the present invention provides air pump apparatus comprising an electric motor, a pump, valve means and electrical operating means contained in a housing, wherein a sound absorption chamber surrounded by sound absorbent material is provided in the housing; wherein a sub-housing is located within the sound absorption chamber; and wherein the pump and motor form a unit which is located in a plenum chamber within the sub-housing.

The arrangement of the chambers is preferably such that the air, passed through the apparatus, is constrained to flow sequentially through the chambers, preferably along a reflex path.

The invention further provides air pump apparatus comprising an electric motor, a valve, a pump and electrical operating means contained in a housing, wherein the pump and motor are encased and form a unit, wherein the housing is an elongate tube in which the unit is located in a plenum chamber in a sub-housing by vibration absorbing damping material, and wherein the sub-housing is located in the housing by further damping material. The plenum chamber is preferably interposed between the pump and the valve.

A filter is preferably included in an air flow path between the sound absorption chamber and an accommodation space in the housing. The sound absorbent material may constitute the filter or part of the filter. The apparatus may include a battery, preferably located in the accommodation space.

The housing preferably comprises an elongate length of tube having end closures. A pipe connection fitting, for pumped air, and manually actuable control means or connection means to connect with manually actuable control means are preferably provided on or exposed via one of the end closures.

The tube is preferably a plastic extrusion.

The apparatus may form one of a range thereof differing in some respects, such as in length, internal arrangement, or end closure configuration, but otherwise of similar general structure in which many common components are employed.

The electrical operating means preferably comprises circuitry mounted on a circuit board located in the accommodation space, through which space there passes a pipe connecting the plenum chamber directly or indirectly with the pipe connection fitting.

The apparatus is preferably arranged so that an inlet flow path for inlet air is provided within the housing between a vent in said end closure and the pump, so that said circuit board and valve are passed by air flowing along the inlet flow path to the inlet duct.

A battery is preferably located in the accommodation space on a carrier which preferably also supports the circuit board, pipe connection fitting, control means or connection means, and which may be provided with electrical input terminals for re-charging the battery.

The apparatus may be arranged to deliver air under pressure to the pipe connection fitting, or to deliver air under pressure to and withdraw air under suction from the pipe connection fitting.

The user of pump apparatus faces problems with the storage of fittings for the apparatus, which problems can be severe in the case of pump apparatus for powering aids for disabled users.

To reduce such problems, the present invention provides pump apparatus in which a pump, motor, battery and control valve are located in a rigid housing; wherein the housing directly supports a cover assembly, which cover assembly includes an openable storage compartment for storing fittings and accessories for the apparatus.

The housing may be cylindrical, and the storage compartment is preferably arranged to support the housing against being rolled.

The invention includes pneumatic support or lifting apparatus such as a wheelchair comprising a pneumatically operated device coupled to or incorporating air pump apparatus of the invention.

The relatively light and inexpensive housing enables a lightweight and inexpensive compressor unit, of the kind produced for vehicle horns, to be employed as the pump and motor unit to be used in situations in which the noise produced by such a unit would otherwise be unacceptable.

BRIEF DESCRIPTION OF THE DRAWINGS

The invention will be described further, by way of example, with reference to the accompanying diagrammatic drawings, wherein.

DETAILED DESCRIPTION

Figure 1:
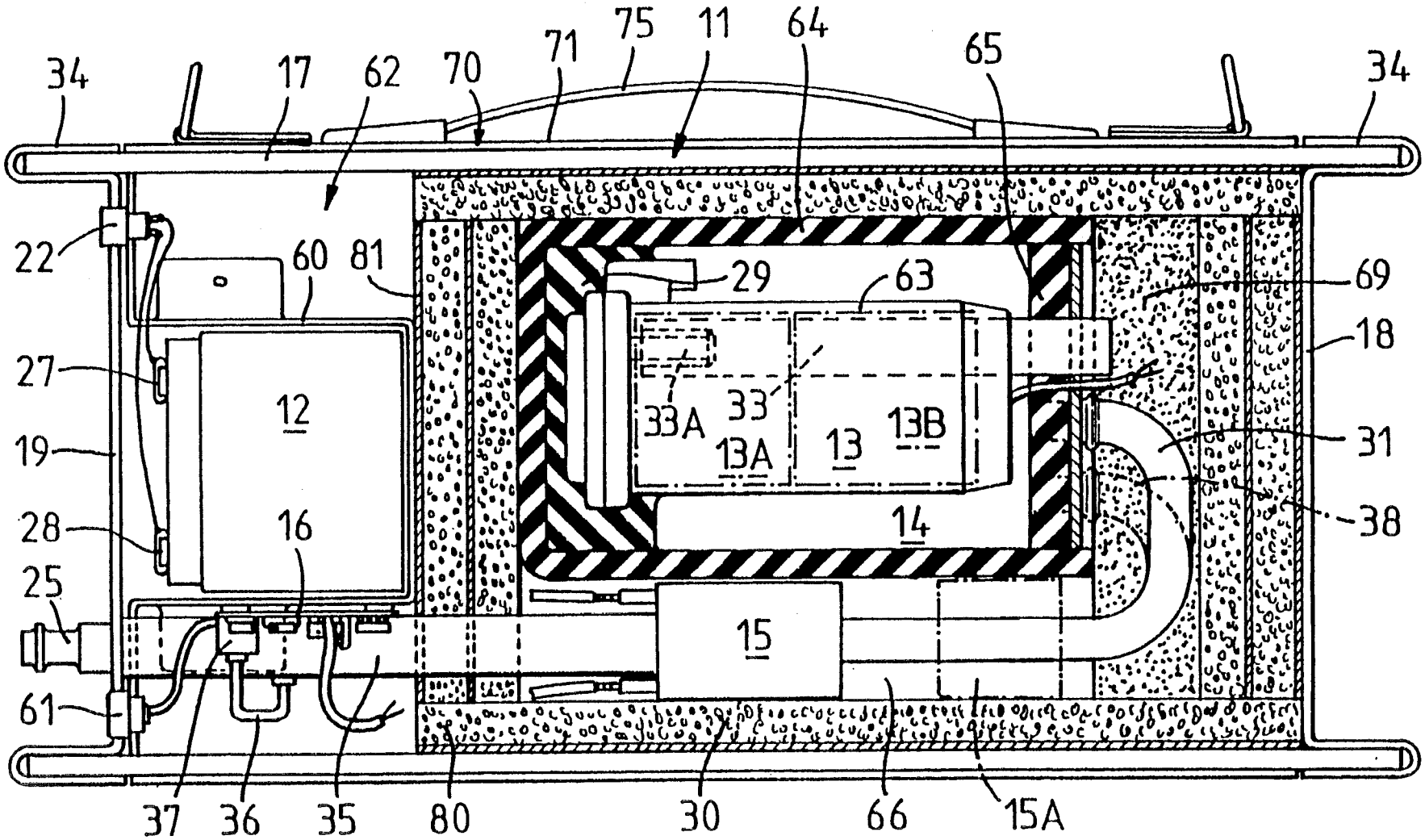
FIGS. 1 and 2 are schematic cross-sectional views showing the general arrangement of a first and second embodiments of air pump apparatus of the invention.
Figure 2:
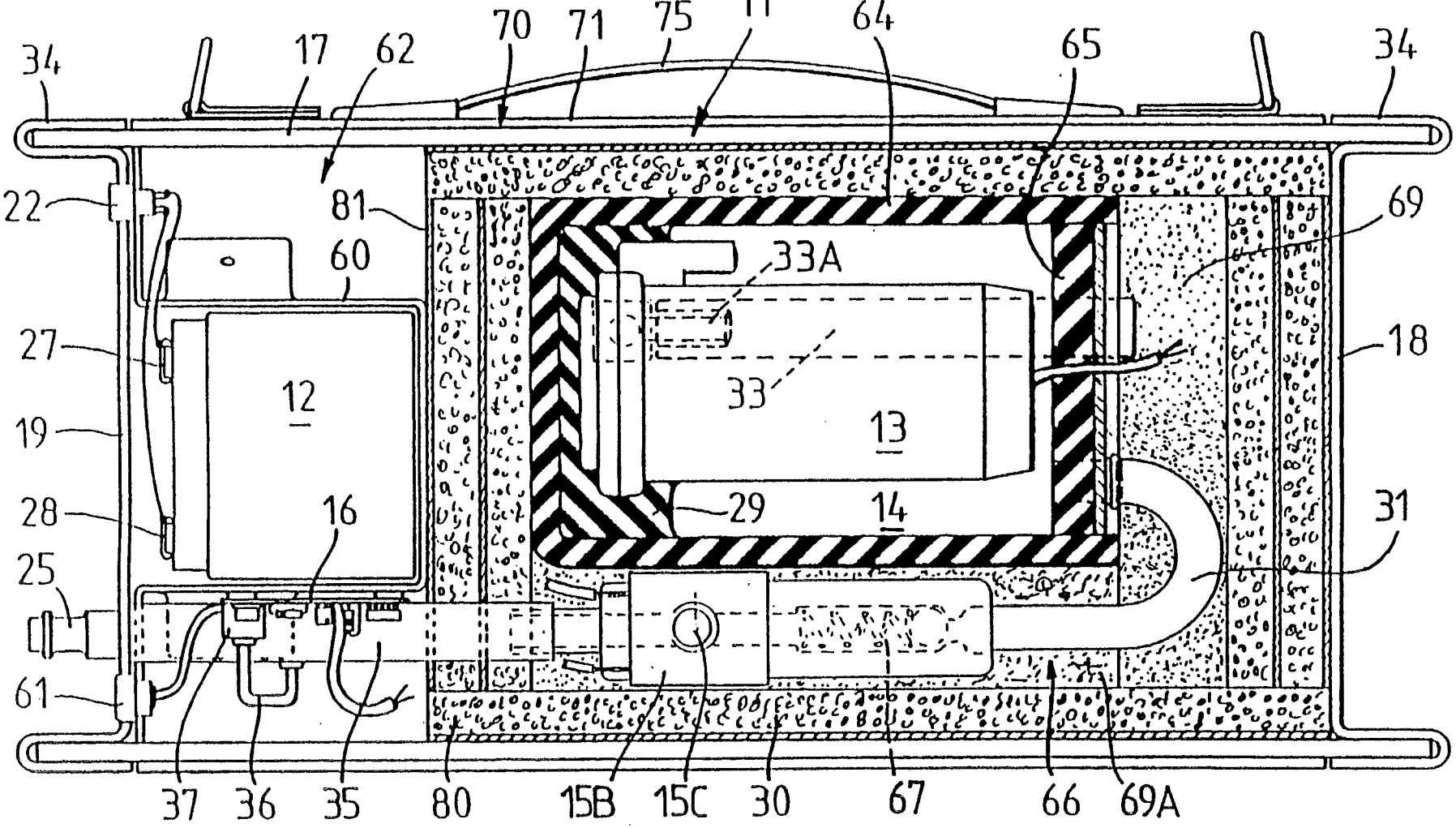

Referring to FIGS. 1 and 2, each of the embodiments of the pump apparatus primarily comprises a housing 11 containing a battery 12, a pump and motor unit 13, a plenum chamber 14, a solenoid actuated normally closed valve 15 and/or 15A or 15B and a circuit board 16.

Figure 3:
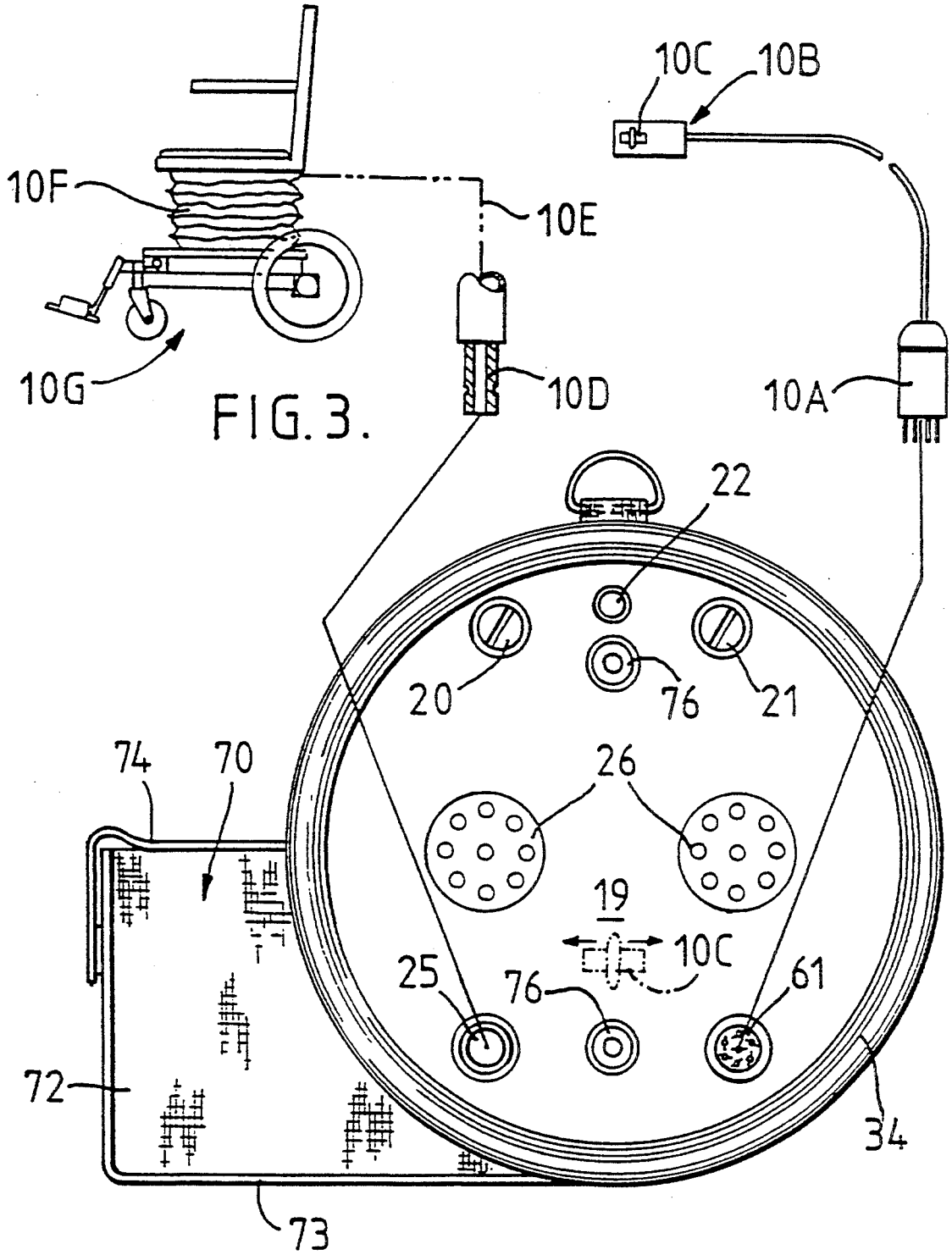
FIG. 3 is a front end elevational view of the apparatus with a diagrammatic representation of a lifting device in a wheelchair, and a remote control unit.

Housing 11 includes a rigid cylindrical body 17, a rear end closure 18 and a front end closure 19. The body 17 is a length of inexpensive mass produced circular cross-section extruded plastics tubing. Each end closure is a cover, the front cover 19 being modified to expose certain parts and fittings of the apparatus which are mounted on a battery support frame 60. The parts include a holder 20 for a motor fuse 40, a holder 21 for a control circuit fuse 41, a charge input socket connector 22, a pumped air connection fitting 25 for reception of a connector 10D of a pressure supply line 10E to a pneumatically actuated lifting device 10F of an aid for a disabled person, for example, a wheelchair 10G. An electrical socket connector 61 received plug lead connector 10A to a remote handset 10B incorporating a combined center-off switch 10C incorporating an up-switch 23 and a down-switch 24 shown in FIGS. 3 and 4 to 5. A duplicate switch 10C may be provided at the front cover 19 as indicated in broken lines in FIG. 3. Two air inlet vents 26 are also provided in the closure 19, which is releasably secured to the frame 60.

The frame 60 is secured to the body 17 of the housing 11 in an accommodation space 62 in the housing.

The battery 12 is a sealed rechargeable 12 volt battery, having terminals 27 and 28, and is secured in the frame 60.

Air pumping 13 is an inexpensive light, but noisy, mass produced 12 volt air compressor (of a kind intended for vehicle air-horns) which comprises a pump 13A and a motor 13B housed in a casing 63. The front end portion of air pumping unit 13, i.e. that portion of the unit 13 in which the material, such as rubber, visco-elastic or elastomeric material, which is set in the front end portion of a thick walled sub-housing 64 of similar vibration damping or absorbent material such as plastics or rubber material so that the unit 13 extends in cantilever manner along the chamber 14. The remainder of the interior of the sub-housing constitutes the plenum chamber 14 and a rear portion of the sub-housing 64 is provided by a sealing closure 65.

The sub-housing 64 and the valve 15 and/or 15A or 15B is or are located in a sound absorbing chamber 66 defined by or substantially filled with sound absorption material 30, such as plastic sheet backed porous foamed plastic or elastomeric material or a fibrous material, which material 30 supports at least portions of the valve and housing 64. A pumped-air tube 31 extends within the chamber 66, is secured to the closure 65 and connects the plenum chamber 14 directly or indirectly with a tube 35 to the pumped or working air connection fitting 25. Air pumping unit 13 is connected by an air inlet supply pipe 33 which is made from flexible preferably vibration absorbent material pipe 33 passes through the plenum chamber 14 and the sealing closure 65 of sub-housing 64 to the sound absorption chamber 66 in which the valve 15 and/or 15A is located. An air pressure line 36 connects the tube 35 (or possibly the fitting 25 or the chamber 14) with a pressure sensitive limit switch 37 on the circuit board 16.

The apparatus is provided with a cover assembly 70 comprising a cylindrical fabric cover 71, which surrounds and grips or is adhered to the peripheral surface of body 17 of the housing between peripheral flanges 34 on the closures 18 and 19, and a storage compartment 72 having a flat bottom 73 tangential to the housing. The compartment 72 has a lid 74. A handle 75 is provided at the top of the assembly 70. The handle may be secured to the cover 71 or the body 17. Apertures in the front closure 19 give access to the fittings mounted on the battery support frame 60. Removal of the closure by releasing fasteners 76 gives access to the battery.

The circuit board 16 carries circuitry and electrical components of electrical operating means which is actuable by manually actuable control means which comprises a remote control unit 10B incorporating the up and down switches which is connectable via a cable having the plug connector 10A insertable into the socket connector 61. The first and second embodiments of the apparatus differ in that the first embodiment (FIGS. 1 and 4A, 4B) is controllable to pump air to and suck air from the fitting 25, whereas the second embodiment (FIGS. 2 and 5, 5A) is arranged only to pump air to the fitting 25. Depending upon the embodiment, the operating and control means may provide for bi-directional operation of air pumping unit 13 employing a circuit such as is shown in FIGS. 4, 4A, 4B or for unidirectional operation of the unit employing a circuit such as is shown in FIGS. 5, 5A.

Figure 4:
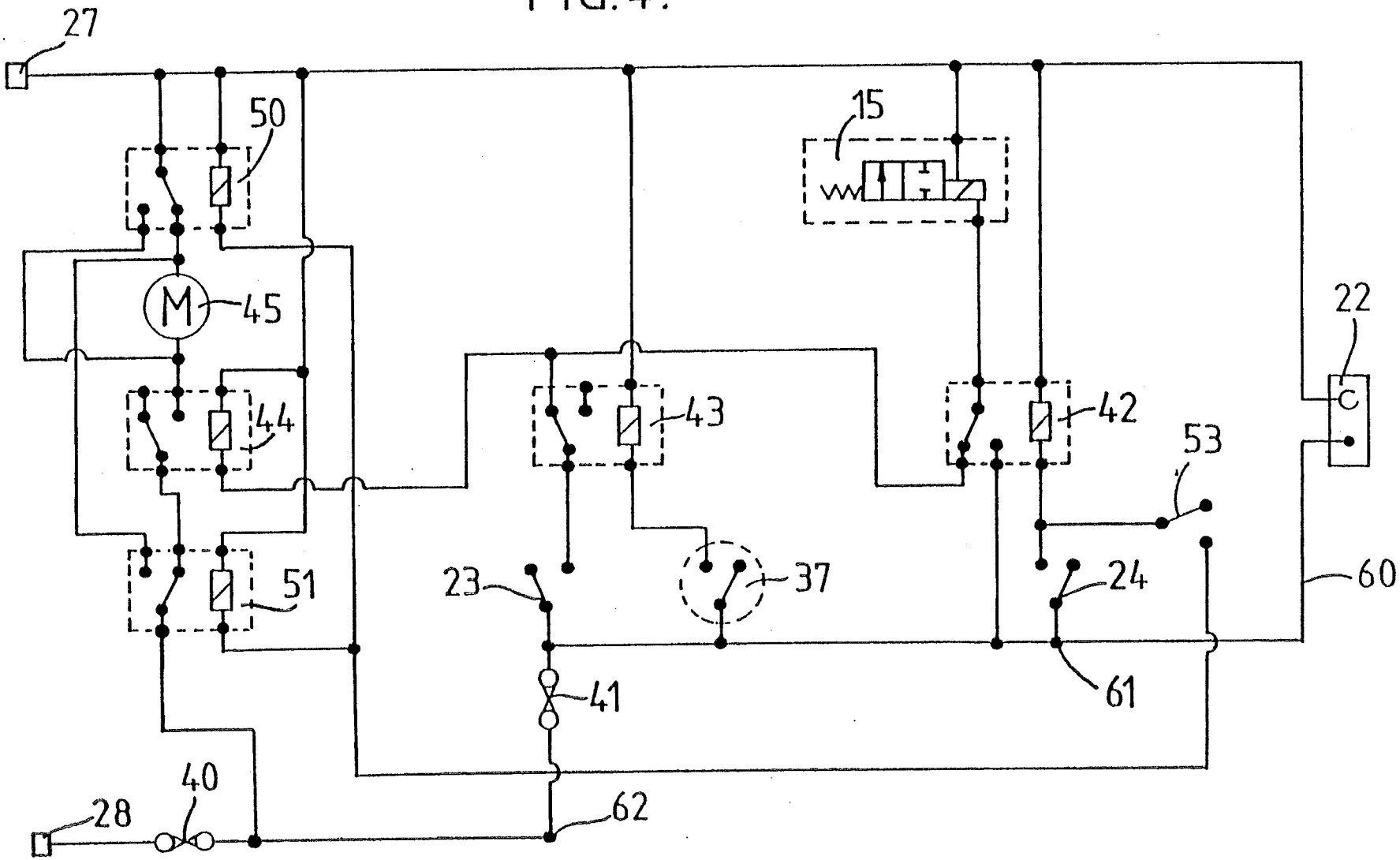
FIGS. 4, 4A and 4B are circuit diagrams for the operating and control means incorporated in the first embodiment.
Figure 4A:
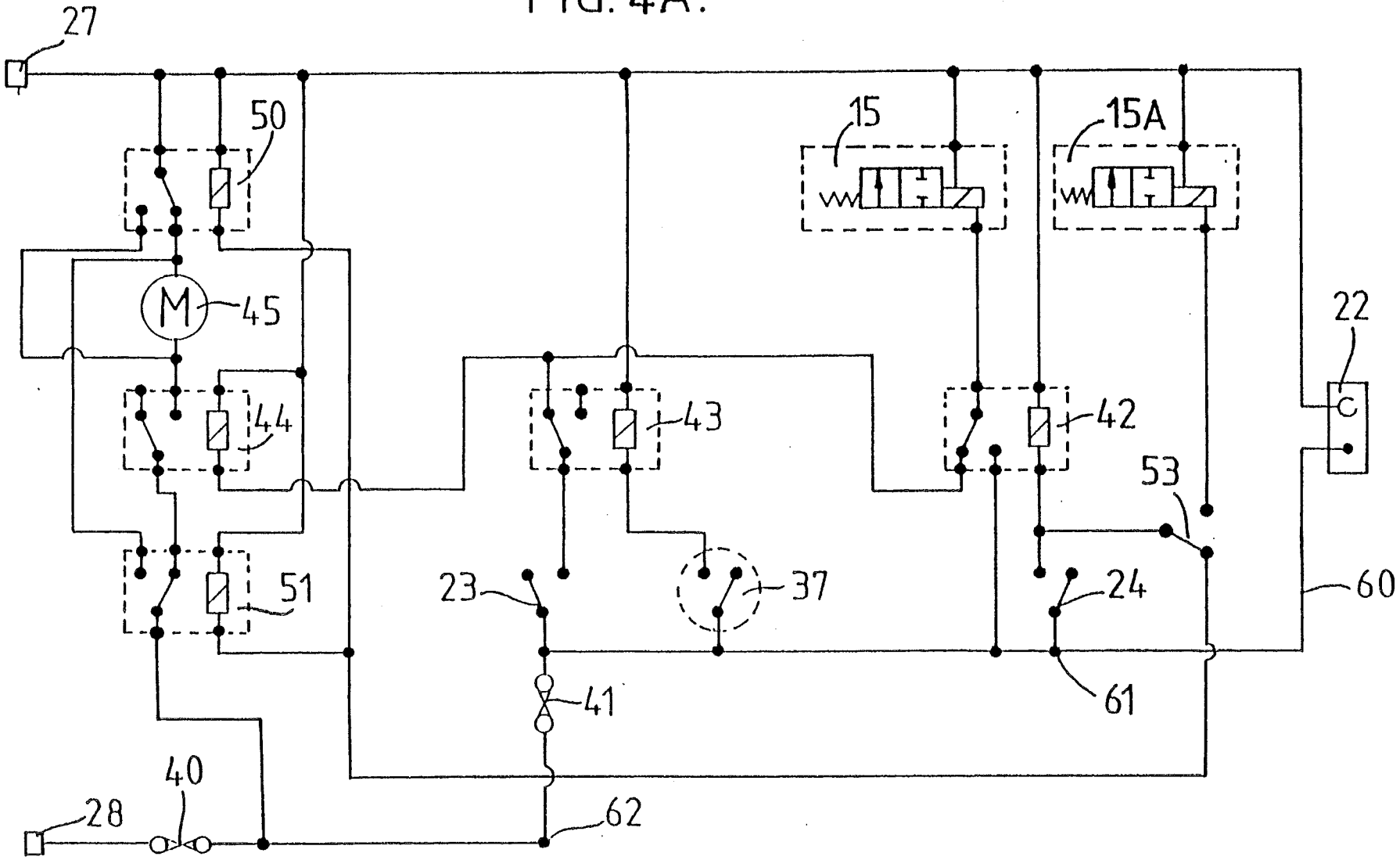
Figure 4B:
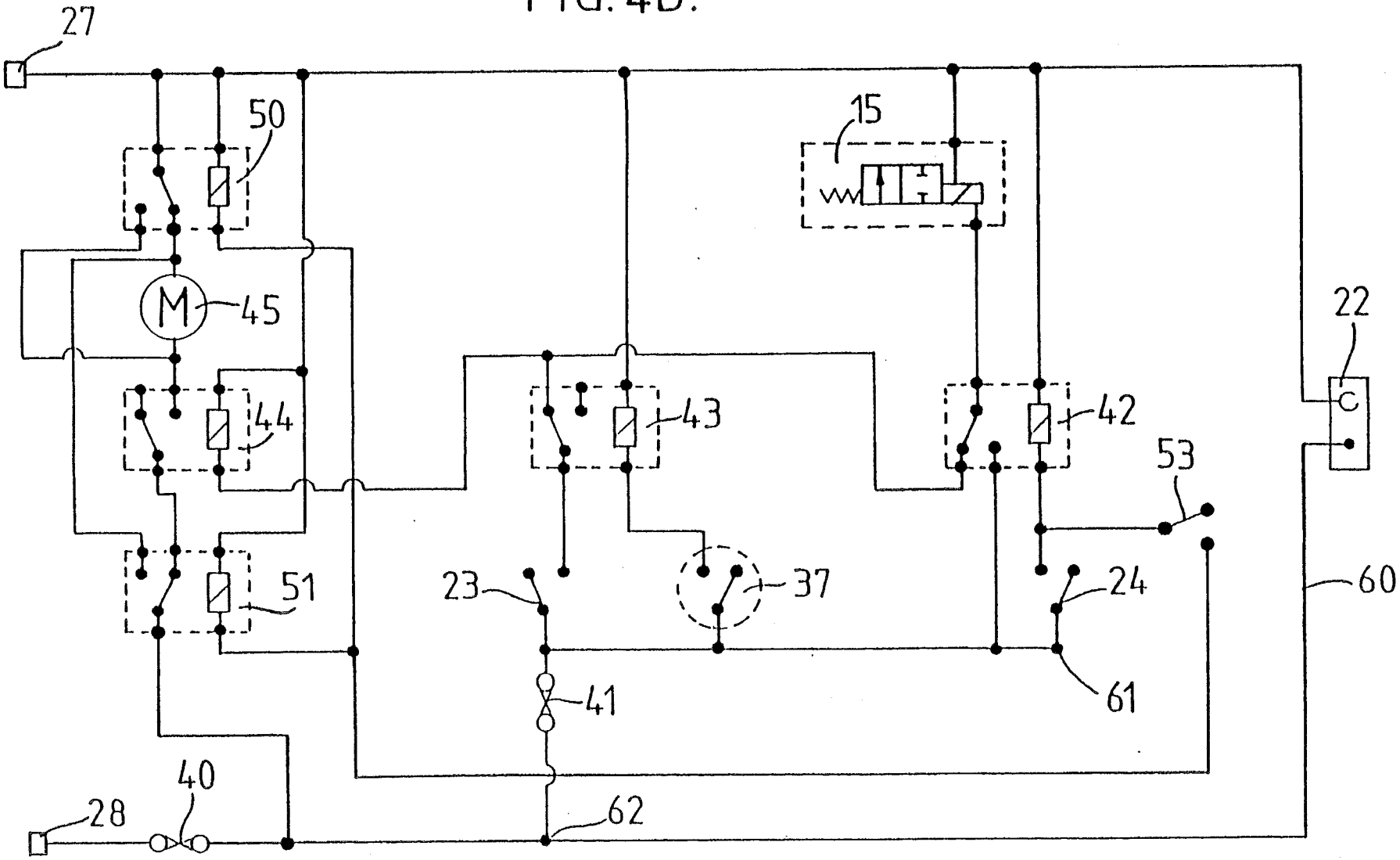
Figure 5:
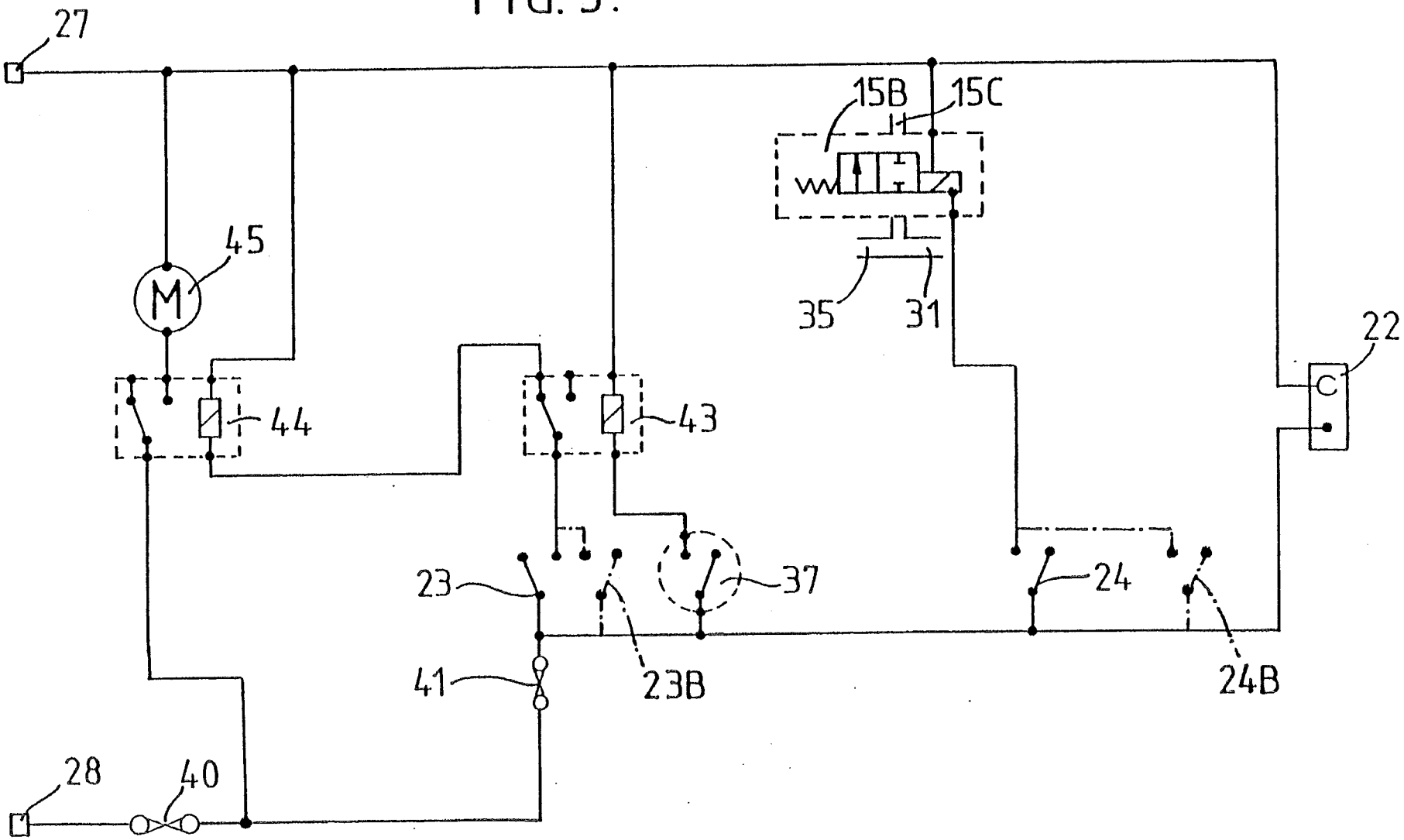
FIGS. 5 and 5A show circuit diagrams for the operating and control means of the second embodiment.
Figure 5A:
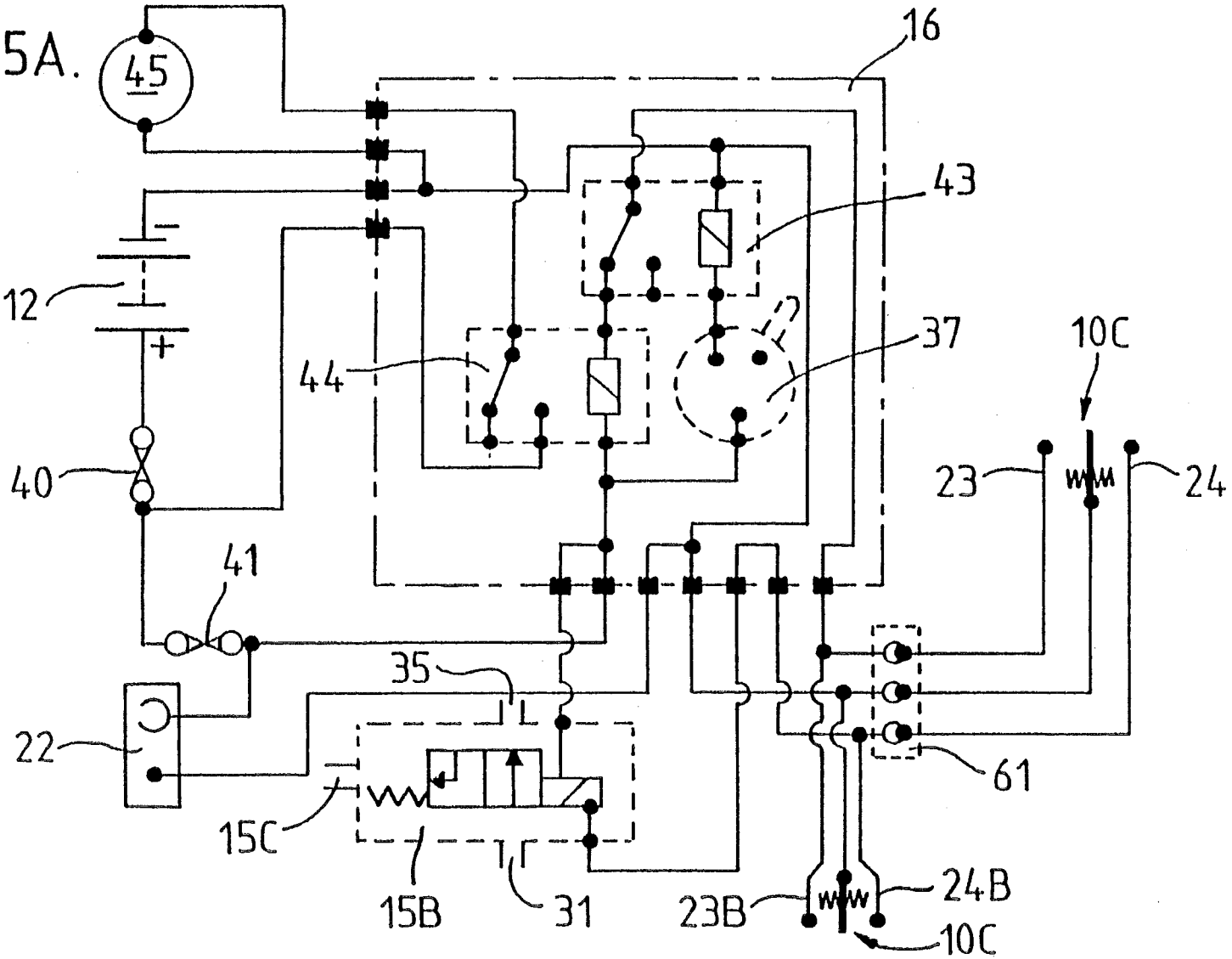

In the first embodiment shown in FIG. 1, the valve 15 is interposed between the tubes 31 and 35 and, as shown in FIG. 4, the circuit includes a "down" relay 42 controlled by the switch 24, a safety relay 43 controlled by the pressure switch 37 and an up relay 44 controlled by the switch 23. In the off condition of the circuit (which condition is illustrated in all FIGURES) the motor 45 of the unit 13 and the valve 15 are de-energized. The battery can be trickle charged via the connector 22 and fuse 41.

When the up switch 23 is closed, the up relay 44 and the valve 15 are activated to energise the motor 45 and open the valve 15 to cause air to be pumped under pressure into the chamber 14, to traverse said chamber 14 and enter the pipe 31 in which it flows forwards within the chamber 66 and via the valve 15 and pipe 35 to the fitting 25; and to draw relief air into the housing via the inlet vents 26 to flow past the circuit board and valve, to enter the front end of the chamber 66 and flow rearwards to the rear end, and to flow into the pipe 33 at said rear end and along said pipe forwards across the chamber 14 to an air inlet 33A of the unit 13.

If the pressure limit set by the switch 37 is reached, this switch closes to activate relay 43 which de-engerizes the relay 44 shutting off the motor, and removes the power supply to the valve 15 so that the valve closes.

When the down switch 24 is closed, relay 42 is activated to energized and open the valve 15 without energizing the motor and irrespective of the condition of the switch 37, so that air under pressure can flow back from the fitting 25 to the vent 26 via the unit 13.

For operating the unit 13 reversibly, the circuit includes pole-reversing relays 50 and 51 and an exhaust switch 53, which switch or a duplicate thereof can also be provided in the remote control unit and/or at the cover 19.

Switch 53 is fed via switch 24 so that when both switches 24 and 53 are closed relays 50 and 51 are activated to energized the motor 45 with reversed polarity of the electrical supply at the same time as the valve 15 is opened, thereby pumping air from fitting 25 to vents 26 via the chamber 14.

It will be readily appreciated that in the first embodiment when only the switch 24 is closed, air under pressure at the fitting 25 can flow back via the unit 13 in which the undriven pump serves as an impedance. If rapid but unpumped venting of air under pressure at the fitting 25 is required in the first embodiment, an additional valve 15A (indicated in broken line in FIG. 1) can be connected to the plenum chamber by a further tube 38, and a vent selection switch 53 included in the control circuit as shown in FIG. 4A.

In the second embodiment, the valve 15 is omitted and the outlet from air pumping unit 13 passes through a mechanical non-return valve 67 and through a normally open path through (FIG. 5A) or by-passing (FIG. 5) the valve 15B to the pipe 35; and the valve 15B is not connected to the plenum chamber by a further tube 38 mounted on the closure 65, but instead opens, when energized, a branch port 15C to discharge air from the pipe 35 directly into the chamber 66 so as to be silenced with minimum flow restriction.

The control circuit is simplified as shown in FIGS. 5 and 5A so that the motor is unidirectionally energizable via switch 23 and normal closed relay 43, and can be isolated by energization of relay 43 by pressure switch 37. The port 15C of the valve 15B remains closed during pumping, and at other times unless switch 24 is closed to allow air under pressure at the fitting 25 to flow back via the tube 35, the valve 15B, the chamber 66 and the accommodation space 62 to the vents 26. The valve 15B could be inserted into the tube 31 or 35 in the first embodiment as a substitute for the valve 15A and tube 38.

Both circuits may be adapted for direct instead of or as well as remote actuation. For example, the switches 23 and 24, or 23, 24 and 53 may be located on the front cover 19 instead of in a portable hand-held control unit, or, as shown in broken lines in FIGS. 5 and 5A supplementary switches e.g. 23B and 24B may be mounted on the cover 19 e.g. as a combined "center-off" switch assembly 10C, to enable the apparatus to be operated when the remote control unit is disconnected from the socket 61.

Both circuits are easily adapted for rapid recharging of the battery, and/or direct operation with or without a battery, by modification of the circuits as shown in FIG. 4B.

In from FIGS. 1 and 2, the sub-housing 64 is relatively thick walled and is made from a solid or otherwise air impervious vibration absorbing elastomeric or plastics material; and the sound absorption chamber 66 is filled partially with porous packing e.g. the layer 69 which serves to support the tubes and the sub-housing 64 as well as to absorb some of the noise from the unit 13. Further porous or fibrous material 69A may be located in the voids shown around the valve 15 and tubes to substantially fill the chamber 66 as indicated in FIG. 2. The annular front end portion 80 of the peripheral layer of sound absorbent material 30 serves as an annular air inlet to the chamber 66 around the front face 81 of the foremost sheet plastics layer of the sound absorbent material 30, so that the peripheral layer serves as an air filter.

Further noise/vibration absorption may be provided by the layer 69 and any additional fibrous material in the chamber 66. The arrangement of the chambers, sound absorbing materials and filtration of the air flows provides a smooth flow of pumped air quietly from a noisy and pulsed output from air pumping unit 13. The noise reduction is further improved by the use of flexible materials which are poor transmitters of sound for the tubes 31, 33, 35 and 38. The valve 15, 15A or valves 15 and 15A may be located in the chamber 14, but if the valve 15B is located in the chamber 14, the port 15C will have to be fitted with a tube to convey air out of the chamber 14 e.g. to the chamber 66.

The invention also includes and provides apparatus having any part, component, function, mode of operation, or feature of arrangement which is novel, or novel in combination with others thereof and is disclosed herein or in the accompanying drawings. For example, the invention includes and provides pneumatic apparatus including an air pump apparatus wherein the pneumatic apparatus includes an air pressure operated device which is solely operated by air which is passed through a single line between said device and a pump unit of the pump apparatus so that all air flowing in said line to and from said device under the control of valve means of the apparatus is constrained to flow through a sound absorbing chamber within the apparatus, and wherein pumped air from the pump unit is also constrained to flow through a plenum chamber in which the pump unit is disposed within the sound absorption chamber. Such air flows are preferably controlled by the pump unit and actuation of a remotely controllable valve.

We claim:

1. Air pump apparatus comprising:

a) a rigid cylindrical housing which directly supports a cover assembly;

b) a sound absorption chamber in said housing;

c) pump means in said sound absorption chamber;

d) duct means within said housing for conveying air from said pump means;

e) a sub-housing is disposed in the sound absorption chamber and defines a plenum chamber to which said duct means connects; and f) said pump means comprises a pump and motor unit mounted in said plenum chamber to discharge air under pressure into said plenum chamber;

g) the cover assembly includes an openable storage compartment for storing fittings and accessories for the apparatus; and h) the storage compartment is disposed to support the cylindrical housing against being rolled.

2. Air pump apparatus comprising:

a) pump means and electrical operating means contained in a housing, b) the pump means comprises a pump and motor unit which is located in a plenum chamber defined by a sub-housing which is composed of vibration absorbing damping elastomeric material to absorb vibration caused by the pump means during its operation, and c) the sub-housing is disposed in further sound or vibration damping material within said housing.

3. Apparatus as defined in claim 2 wherein
a filter is included in an air flow path between the plenum chamber and an accommodation space in the housing.

4. Apparatus as defined in claim 3 wherein
sound absorbent material constitutes at least a portion of the filter.

5. Apparatus as defined in claim 3 wherein
a valve is located in the air flow path, and
the plenum chamber is interposed between the pump and the valve.

6. Apparatus as defined in claim 3 wherein
the housing comprises an elongate body having end closures; a pipe connection fitting for pumped air, and electrical connection means are located at one of the end closures;
the electrical operating means includes circuitry mounted on a circuit board located in the accommodation space, through which space there passes a pipe connecting the plenum chamber with the pipe connection fitting; and
inlet flow path means for inlet air within the housing between a vent in said end closure and the pump, so that said circuit board is passed by air flowing along an inlet flow path to the pump and motor unit.

7. Apparatus as defined in claim 3 wherein
a battery is located in the accommodation space on a carrier, the carrier also supporting a circuit board, a pipe connection fitting, control means, and connection means which includes electrical input terminals for recharging the battery.

8. Air pump apparatus comprising:
a) rigid housing means defining a sound absorption chamber;
b) sub-housing means disposed in the sound absorption chamber and defining a sealed plenum chamber;
c) pump means mounted in said sealed plenum chamber to discharge air under pressure directly into said sealed plenum chamber; and
d) means for conveying air within said rigid housing means to said pump means and from the sealed plenum chamber.

9. Apparatus as defined in claim 8 wherein
said means for conveying air includes a pumped air tube disposed in the sound absorption chamber and connected to the sub-housing means to convey air under pressure from the sealed plenum chamber through the sound absorption chamber.

10. Apparatus as defined in claim 8 wherein
sound absorbing material is disposed in the sound absorption chamber to surround and support the sub-housing means, and
said sub-housing means is made of an air impervious polymeric material.

11. Apparatus as defined in claim 8 wherein
the housing is cylindrical and rigid, and directly supports a cover assembly,
the cover assembly includes an openable storage compartment for storing fittings and accessories for the apparatus, and
the storage compartment is disposed to support the cylindrical housing against being rolled.

12. Air pump apparatus as defined in claim 8 wherein
a pneumatically operable device is coupled to said means for conveying air from said pump means, said pneumatically operable device being mounted to a pneumatic support or lifting apparatus.

13. Apparatus as defined in claim 8 wherein
said means for conveying air includes a supply duct extending from the sound absorption chamber through the sealed plenum chamber to convey air to the pump means.

14. Apparatus as defined in claim 13 wherein
porous sound absorbing material is disposed in the sound absorption chamber and defines air filter means, and
the pump means is disposed to draw air through the sound absorbing material to the supply duct.

15. Air pump apparatus comprising:
a) housing means containing an electric motor, an air pump driven by the electric motor, valve means, and means for electrically operating the motor;
b) said housing means including sound absorbent means defining a sound absorption chamber;
c) said housing means including sealed sub-housing means defining a sealed plenum chamber and being located within the sound absorption chamber;
d) the pump and motor form a unit which is mounted by elastomeric material in the sealed plenum chamber to discharge air into and pressurize the sealed plenum chamber; and
e) air conveying means extends through the sound absorption chamber to the sub-housing means therein to receive pressurized air from the sealed plenum chamber.

16. Apparatus as defined in claim 15 wherein
the air conveying means directs air to flow through (a) the sound absorption chamber; (b) a pipe in the plenum chamber; (c) the pump; (d) the plenum chamber, and (e) duct means within the sound absorption chamber.

17. Apparatus as defined in claim 15 wherein
the air conveying means includes duct means within the sound absorption chamber,
the valve means is disposed in the sound absorption chamber, is supported by the sound absorbent material, and controls the flow of pressurized air through said duct means.

18. Apparatus as defined in claim 15 wherein
the electrical operating means is effective to perform at least one of the following:
a) to open the valve means when the pump is running,
b) to close the valve means when the pump is not running,
c) to control the opening and closing of the valve means when the pump is not running to selectively prevent or permit air to flow through the sealed plenum chamber, and
d) to open the valve means when the pump is not running to vent air into the sound absorption chamber without the air flowing through the sealed plenum chamber.

19. Air pump apparatus comprising:
a) pump means and electrical operating means contained in a housing;
b) the pump means including a pump and motor unit which is located in a sealed plenum chamber defined by a sub-housing;
c) vibration absorbing damping material mounts the pump and motor unit to discharge pressurized air into the sealed plenum chamber;

d) the sub-housing is located in and separated from the housing by sound and vibration damping material; and e) duct means extends through the sound and vibration damping material and is connected to the sub-housing to convey air under pressure from the plenum chamber to outlet means.

20. Apparatus as defined in claim 19 wherein sound absorbent material defines at least a portion of a filter for filtering air passing through a sound and vibration absorption chamber extending from acommodation space to the pump and motor unit.

21. Apparatus as defined in claim 19 wherein a valve is connected in said duct means to control discharge of pressurized air via said duct means.

22. Apparatus as defined in claim 19 wherein said housing includes an accommodation space located between one end of the housing and a sound and vibration absorption chamber.

23. Apparatus as defined in claim 22 wherein the housing includes an elongated hollow body having end closures and a pipe connection fitting for pumped air, and electrical connection means are located at one end of one of said closures;

the electrical operating means includes circuitry mounted on a circuit board located in the accommodation space, through which space there passes a pipe connecting the plenum chamber with the pipe connection fitting; and inlet flow path means for inlet air within the housing between a vent in said one of the end closures and the pump, so that said circuit board is passed by air flowing along an inlet flow path to the pump and motor unit.

24. Apparatus as defined in claim 22 wherein said electrical operating means includes a battery, a carrier, a circuit board, a pipe connection fitting, control means, and connection means all located in the accommodation space, the battery is supported on the carrier which also supports the circuit board, pipe connection fitting, control means, and connection means.

* * * * *